US009464363B2

(12) United States Patent
Menuey et al.

(10) Patent No.: US 9,464,363 B2
(45) Date of Patent: Oct. 11, 2016

(54) METHOD AND AN ASSEMBLY FOR ELECTROLYTICALLY DEPOSITING A COATING

(75) Inventors: Justine Menuey, Annecy (FR); Frederic Braillard, Chatellerault (FR); John Foster, Weston-S-Mare (GB); Stephen Owens, Weston-S-Mare (GB); Alan Taylor, Axbridge (GB); Martin Chatterney, Durnway Bleadon Som (GB)

(73) Assignees: SNECMA, Paris (FR); PRAXAIR SURFACE TECHNOLOGIES INC., Indianapolis, IN (US)

( * ) Notice: Subject to any disclaimer, the term of this patent is extended or adjusted under 35 U.S.C. 154(b) by 931 days.

(21) Appl. No.: 13/519,350

(22) PCT Filed: Dec. 28, 2010

(86) PCT No.: PCT/FR2010/052928

§ 371 (c)(1),
(2), (4) Date: Nov. 14, 2012

(87) PCT Pub. No.: WO2011/080485

PCT Pub. Date: Jul. 7, 2011

(65) Prior Publication Data

US 2013/0048503 A1 Feb. 28, 2013

(30) Foreign Application Priority Data

Dec. 29, 2009 (FR) ..... 09 59633

(51) Int. Cl.
*C23C 10/60* (2006.01)
*C23C 10/02* (2006.01)

(Continued)

(52) U.S. Cl.
CPC ..... *C25D 17/008* (2013.01); *C25D 5/022* (2013.01); *C25D 5/16* (2013.01); *C25D 15/00* (2013.01); *F01D 5/005* (2013.01)

(58) Field of Classification Search
CPC ..... C25D 15/00; C23C 10/60; C23C 10/02
USPC ..... 204/285, 286.1; 205/109
See application file for complete search history.

(56) References Cited

U.S. PATENT DOCUMENTS 5,833,829 A 11/1998 Foster
2006/0037865 A1 2/2006 Rucker et al.

(Continued)

FOREIGN PATENT DOCUMENTS

EP 0 724 658 8/1996

OTHER PUBLICATIONS

International Search Report Issued Mar. 23, 2011 in PCT/FR10/52928 Filed Dec. 28, 2010.

*Primary Examiner* — Zulmariam Mendez
(74) *Attorney, Agent, or Firm* — Oblon, McClelland, Maier & Neustadt, L.L.P.

(57) ABSTRACT

A method for repairing a blade forming a cathode and having a surface to be coated defining a critical area, utilizing an anode, an electrolyte bath including insoluble particles, and a mounting on which the blade is mounted in a working position relative to a reference wall. The mounting is placed in the bath, and the particles and the metal of the anode are co-deposited to form the coating on the surface to be coated. The anode is typically placed facing the critical area and the mounting includes a mechanism for monitoring current lines to obtain a coating with a relatively constant, predetermined thickness for the critical area, that gradually falls to a value of substantially zero along edges of the coating.

15 Claims, 2 Drawing Sheets

(51) Int. Cl.

| | |
|---|---|
| ***C25D 15/00*** | (2006.01) |
| ***C25D 17/00*** | (2006.01) |
| ***C25D 5/02*** | (2006.01) |
| ***C25D 5/16*** | (2006.01) |
| ***F01D 5/00*** | (2006.01) |

(56) References Cited

U.S. PATENT DOCUMENTS

| | | | |
|---|---|---|---|
| 2006/0275624 | A1 | 12/2006 | Rucker et al. |
| 2008/0035486 | A1 | 2/2008 | Albrecht et al. |
| 2008/0302667 | A1 | 12/2008 | Rucker et al. |

METHOD AND AN ASSEMBLY FOR ELECTROLYTICALLY DEPOSITING A COATING

BACKGROUND OF THE INVENTION

1. Field of the Invention

The invention relates to a method of depositing a composite coating comprising a metallic matrix containing particles, for the purpose of repairing a metal blade, particularly but not exclusively a blade of a gas turbine nozzle.

The invention relates in particular to a method of depositing a coating of the $M_1CrAlM_2$ type, where $M_1$ is selected from Ni, Co, or Fe, or a mixture thereof, and $M_2$ is selected from Y, Si, Ti, Hf, Ta, Nb, Mn, Pt, and rare earths.

2. Description of the Related Art

The continuing improvement in the efficiency of modern gas turbines makes it necessary to use inlet temperatures to the turbine that are ever higher. This trend has led to ever more refractory materials being developed to make the parts of the high pressure turbine such as moving blades and nozzles.

For this purpose, monocrystalline superalloys have been developed with very high volume fractions of the gamma prime phase that presents hardening properties.

Nevertheless, the development of superalloys no longer suffices for keeping up with the increasing requirements in terms of lifetime for parts that withstand high temperatures. That is why, more recently, thermally insulating coatings have come into service for lowering the temperature of the metal of parts that are cooled by internal convection. These thermally-insulating coatings or "thermal barriers" are made of a layer of ceramic based on zirconia stabilized by yttrium oxide and deposited on a metallic bonding layer to provide adhesion for the ceramic coating while protecting the metal of the part from being oxidized.

The bonding layer, referred to as an undercoat, may be of various types. Mention can be made of layers of the MCrAlY type (where M stands for nickel or cobalt). Mention can be made in particular of layers of the aluminide (NiAl) type having an intermetallic structure, compounds which are defined as having 50% atomic of nickel and aluminum. Such aluminides may be modified by a precious metal such as platinum. Aluminide coatings are made up of an outer layer formed together with a layer that diffuses into the substrate. All those undercoat systems have as their common denominator the property of being alumina-forming, i.e. by oxidizing they form a protective alumina film that adheres well and that isolates the metal of the part from the oxidizing environment.

In spite of all the protections added to parts, such as undercoats and thermal barriers, they nevertheless oxidize and they run the risk of cracking. In order to enable such parts to continue to be used, it is therefore necessary to repair the various defects they might present after a certain length of service.

In order to repair a part such as a nozzle coated with a thermal barrier, it is known to be necessary to remove the ceramic coating and then the metallic undercoat. It is then necessary to deoxidize the part by thermal and chemical treatment under a halogen atmosphere. The part can then be repaired by a welding and/or brazing technique. Once the part has been built up, the metallic undercoat is restored and then the ceramic layer.

The thermal barrier is conventionally removed by sand blasting. Sand blasting is an operation that is aggressive both to the ceramic layer and to the metallic undercoat. The undercoat is subsequently removed by being dissolved chemically in a bath of acid. That operation is difficult since it leads to the diffused layer of the aluminide coating being dissolved and thus it leads in practice to reducing the wall thicknesses of the part. Such a reduction in the wall thickness of the parts leads to an increase in flow section, in particular for nozzles.

In a turbomachine nozzle, a sector is a part comprising one or more blades mounted on interconnected platforms. Sectors are united to form a ring that essentially constitutes the nozzle. Strictly-speaking, the flow section of a sector is the area, measured perpendicularly to the flow direction, of the passage along which the stream passes through the nozzle sector, between two adjacent blades. By extension, the flow section is used to designate more simply the width of the passage for the stream through the nozzle sector. This flow section is conventionally measured at that location between the leading edge and the trailing edge at which the value of the flow section is the smallest, which corresponds to the location of the narrowest passage for the stream.

It is known that when the flow section is increased, that tends to diminish the performance of an engine by diminishing the exhaust gas temperature (EGT) margin.

It is therefore necessary to be in a position to add material at the location where the part determines the performance of the engine, while conserving good mechanical properties and the ability to withstand oxidation and corrosion.

The traditional technology comprises building up the part by brazing on a frit based on superalloy and a brazing material. That technology is not particularly suitable since it presents various drawbacks.

By definition, frits and brazing powders are made of meltable elements that form compounds having a melting point close to the operating temperature of the parts. It is therefore not recommended to use materials of this kind over large areas that are exposed to extreme temperatures. As a result, the mechanical characteristics of brazed zones are well below those of bare substrates.

Furthermore, making a deposit by brazing always leads to an edge that forms a step, i.e. an extra thickness of material all along the built-up zone. The presence of this step can disturb the flow of the stream of air (in the air flow section), so subsequent machining is necessary to restore the proper aerodynamic profile.

Furthermore, it can happen that the trailing edge of the nozzle is not thick enough for it to be brazed: brazing is accompanied by elements being diffused over thicknesses that may be as great as 300 micrometers (μm) and that therefore degrade the integrity of the substrate over said thickness.

BRIEF SUMMARY OF THE INVENTION

An important aspect of the present invention is to provide a method enabling the drawbacks of the prior art to be overcome, in particular by making it possible to address the problem of restoring flow section while also complying with criteria imposed by the environment of the parts.

Thus, in particular, in order to build up flow section measurement zones, it is necessary to use a material that does not degrade mechanical characteristics. Furthermore, the buildup needs to be performed in such a manner as to avoid disturbing streamlines.

To this end, according to the present invention, the method is a method of electrolytically depositing a composite coating comprising a metallic matrix containing particles, for the purpose of repairing a metal blade, the method implementing the following steps:

- providing at least one blade forming the cathode and presenting a surface to be coated that defines a critical zone;
- providing an anode made of a metal and connecting the anode to a current source;
- providing a solution forming an electrolyte bath and containing insoluble particles;
- providing a support made of a material that does not conduct electricity, that presents a reference wall, and that is suitable for receiving said blade in a working position relative to the reference wall;
- mounting said blade on said support in said working position;
- placing the support in said solution; and
- co-depositing particles and metal from the anode so as to form a coating on the surface to be coated.

In characteristic manner, said anode is placed facing the critical zone, and said support is fitted, for each blade, with means for controlling lines of current so as to obtain, on the surface to be coated of said blade, a coating presenting varying thickness that is predetermined and relatively constant for the critical zone and that decreases progressively down to a value of substantially zero along the edges of said coating.

These means for controlling lines of current contains preferably one or more shield portions on the surface of said support which faces the surface to be coated of the blade.

In this way, it can be understood that by using an electroplating technique that is simple to implement, it is possible to obtain directly the thickness that is desired for the coating, which thickness varies as a function of location on the part, and this can be done without forming a step along the edge of the coating and while complying with strict dimensional constraints for the flow section.

This solution also presents the additional advantage of making it possible for the coating to be deposited solely on the zone or each zone of the surface to be coated that needs to be coated.

Furthermore, the method of the present invention makes it possible to process a plurality of parts simultaneously.

It should also be mentioned that the electroplating technique disturbs the substrate to a smaller extent since, unlike a buildup method using brazing, diffusion takes place only over a few micrometers.

Overall, the solution of the present invention makes it possible to make a deposit having the desired characteristics in terms of withstanding oxidation and corrosion, and of having thickness and a shape that avoid any disturbance to the streamlines without any need for subsequent retouching (machining).

In a preferred arrangement, said surface to be coated extends in a longitudinal direction between the root and the tip of the blade. A non-conducting support is constructed to hold an anode facing said surface to be coated. The shape of the anode can be selected to control the flow of current to the critical zone and create the peak coating thickness at the throttle point and a smooth transition from coated to non-coated areas. The shape of the anode may be selected from a number of different designs including but not limited to rod, bar, sheet or a shape following the form of the aerofoil. The non-conducting support for the anode defines the position of the anode relative to the surface to be coated and may be designed to control the lines of current flowing from the anode to the surface to be coated. To that end, said means for controlling lines of current comprise a longitudinal portion of the support suitable for facing said surface to be coated of said blade, said portion defining a location for the anode extending in the longitudinal direction and facing the critical zone, the profile and the position of the longitudinal portion of the support and the shape and position of the anode relative to the surface to be coated being selected so as to limit and orient the lines of current.

Preferably, the blade(s) are blades of a turbomachine nozzle.

The invention also provides a method of restoring blades comprising the steps of:

(i) removing existing coatings from a blade to form a surface to be coated, (ii) preparing or cleansing said surface to be coated;

(iii) coating said surface to be coated of the blade with MlCrAlM2 type material, according to the method of electrolytically depositing a coating of the invention described before, to build up the blade; and (iv) implementing a diffusion heat treatment The invention also provides an assembly for electrolytically depositing a coating on a blade, the assembly being specifically adapted for implementing the method of the invention.

For this purpose, there is provided an assembly for electrolytically depositing a coating on a blade, the assembly comprising:

- at least one blade forming the cathode and presenting a surface to be coated that defines a critical zone; and
- a support made of a material that does not conduct electricity, presenting a reference wall, and suitable for receiving said blade in a working position relative to the reference wall, said support further comprising, for each blade, a longitudinal portion suitable for facing said surface to be coated of said blade, said portion defining a location for the anode extending in a longitudinal direction and facing the critical zone, an anode being housed in said location, the profiles and the positions of the longitudinal portion of the support and the shape and position of the anode relative to the surface to be coated being selected to limit and orient the lines of current in such a manner as to obtain, on the surface to be coated of said blade, a coating presenting varying thickness that is predetermined for the critical zone and that decreases progressively to a value of substantially zero along the edges of said coating.

In particular, the longitudinal portion includes a working wall that faces the surface to be coated and that presents a profile of a shape that is adapted to cause the lines of current to enable the coating to be deposited on the surface to be coated so that it has the desired characteristics, in particular in terms of its thickness.

BRIEF DESCRIPTION OF THE SEVERAL VIEWS OF THE DRAWINGS

Other advantages and characteristics of the invention appear from the following description made by way of example and with reference to the accompanying drawings, in which.

DETAILED DESCRIPTION OF THE INVENTION

Figure 1:
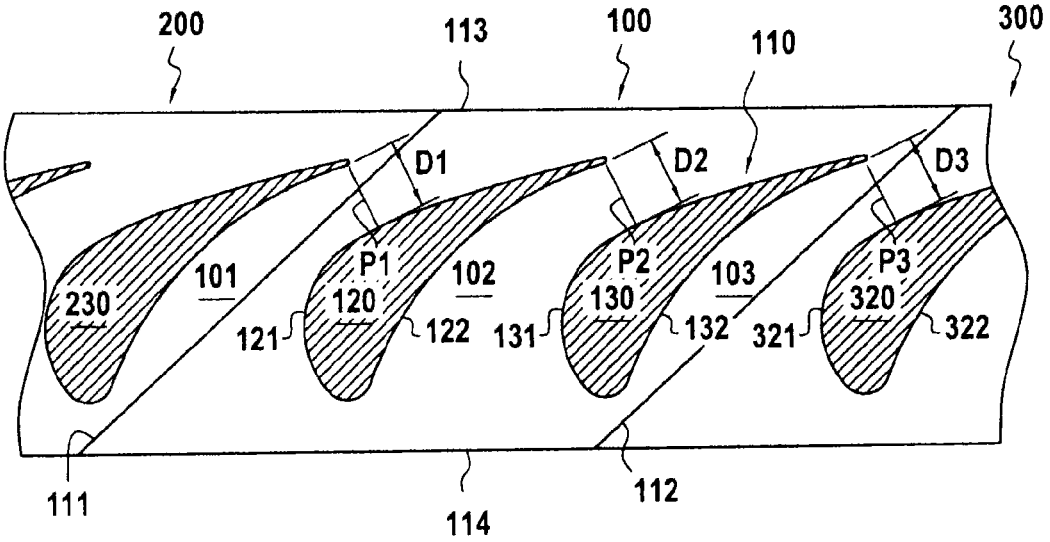
FIG. 1 is a section view perpendicular to the axes of two blades of a nozzle sector, showing the locations where flow section is measured.

The nozzle sector 100 shown in part in FIG. 1 comprises two substantially parallel platforms of substantially cylindrical shape about the axis of the nozzle 100 (only one of the two platforms 110 can be seen in FIG. 1).

These platforms 110 present an outline of quadrilateral shape, and specifically of parallelogram shape. The four sides of the parallelogram comprise two opposite sides forming contact surfaces 111 and 112 directed respectively towards the two nozzle sectors 200 and 300 disposed on either side of the sector 100 under measurement (in the assembled relative position). The contact surfaces 111, 112 are designed to hold adjacent nozzle sectors, e.g. the sectors 100, 200, and 300 of FIG. 1, in the contacting relative position. The other two sides of the parallelogram form lateral faces 113, 114 that define the two outer circles of the ring formed by the nozzle.

The nozzle sector 100 also has two blades 120, 130. Each of these blades presents an aerodynamic profile having a suction side 121, 131 and a pressure side 122, 132. Since there are only two blades in the sector 100, each of the blades 110, 120 is an end blade. Thus, each of these blades is placed facing an end blade of an adjacent nozzle sector when in the assembled relative position. More precisely, the suction side 121 faces the pressure side 232 of the blade 230, and the pressure side 132 faces the suction side 321 of the blade 320. The blades 230 and 320 are standard blades that are used as reference blades for measuring the flow sections through the nozzle 100. Between the various blades 230, 120, 130, 320, there are formed respective inter-blade passages 101, 102, and 103. The inter-blade passage 102 is formed between the blades 120 and 130 of the sector 100. In contrast, the inter-blade passages 101 and 103 are formed between firstly one of the blades (120 or 130) of the sector 100 under consideration, and secondly the facing reference blade 230 or 320.

As can be seen in FIG. 1, in a given inter-blade channel, the distance between the blades varies as a function of position along the channel. Usually, for any given inter-blade channel, there is only one plane in the channel for which this distance and the flow section are at a minimum. This plane corresponds to the planes P1, P2, and P3 respectively for the inter-blade passages 101, 102, and 103; the distances between the blades in these sections are respectively D1, D2, and D3, with these three distances corresponding to three measurements taken on the measurement bench.

Figure 2:
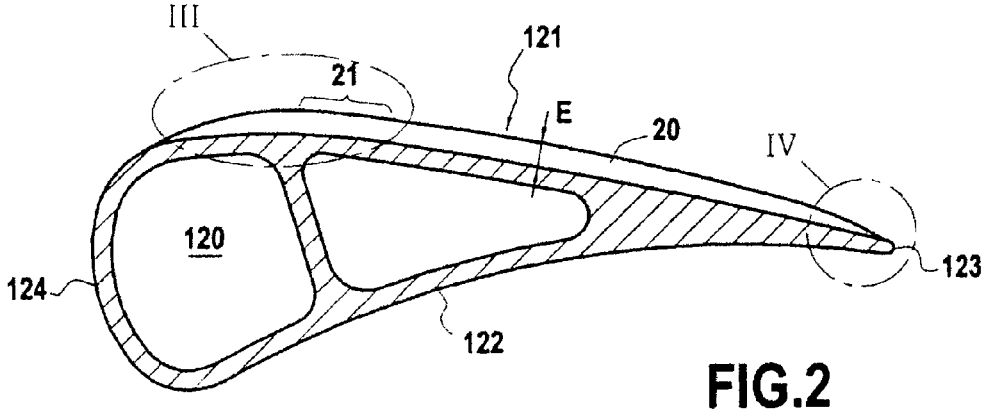
FIG. 2 is a section view on a larger scale of a blade coated using the method of the present invention.

As can be seen more clearly in FIG. 2, in this implementation of the method of the invention, the surface to be coated of said blade 120 (or 130) is its suction side wall 121 (or 131).

Nevertheless, by implementing the method of the invention, it is also possible simultaneously to apply a coating 20 on the pressure side 122, 132 of the two blades 120 and 130 of the nozzle sector 110.

In FIG. 2, there can be seen a section of the blade 120 in a transverse plane that is orthogonal to the longitudinal direction along which the blade 120 extends. In FIG. 2, the coating 20 obtained by the method of the invention extends on the suction side 121 only, essentially over the entire area of said suction side 121, firstly between the two longitudinal ends that are mounted on the platforms, and secondly between the leading edge 124 and the trailing edge 123.

As can be seen in FIG. 2, the coating 20 presents a mean thickness E that is relatively constant over its entire area, with the exception of the edge where the thickness of the coating 20 decreases progressively from its mean value E to a value of substantially zero.

Figure 3:
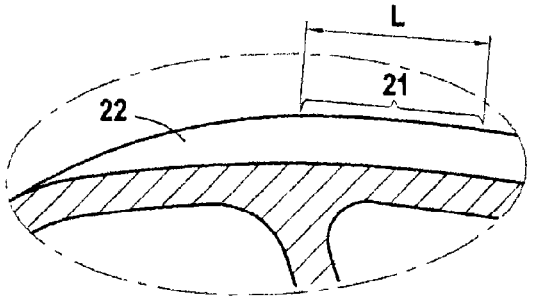
FIG. 3 is an enlargement of a zone III in FIG. 2.

More precisely, as shown in FIG. 3, the upstream edge 22 of the coating 20, i.e. the edge adjacent to the leading edge 124 of the blade 120, forms a layer of decreasing thickness towards the leading edge 124, so that there is no discontinuity or step between the leading edge 124 and the coating 20 covering the suction side 121. This absence of any step avoids any disturbance to the flow in the inter-blade channel 101 of FIG. 1.

Figure 4:
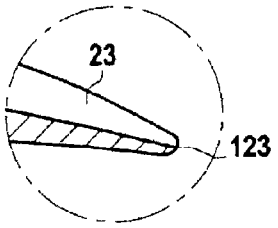
FIG. 4 is an enlargement of a zone IV in FIG. 2.
Figure 5:
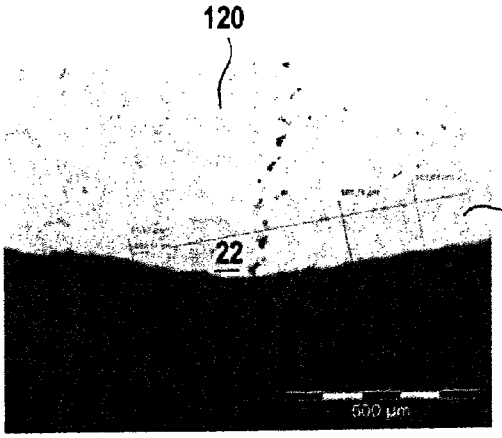
FIG. 5 is a micrographic view in section corresponding to the zone III of FIG. 3, in which there can be seen the progressive variation in coating thickness along one of its edges.
Figure 6:
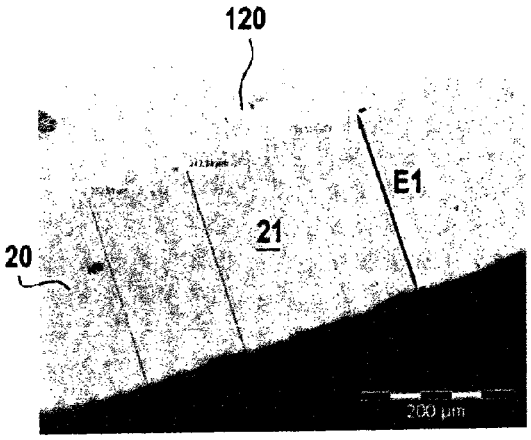
FIG. 6 is a micrographic view in section corresponding to the critical zone of FIG. 3, in which the predetermined and relatively constant thickness of the coating for the critical zone can be seen.

In analogous manner, and as can be seen in FIG. 4, the downstream edge 24 of the coating 20, i.e. the edge adjacent to the trailing edge 123 of the blade 120, forms a layer of thickness that decreases towards the trailing edge 123, so that there is no discontinuity or step between the trailing edge 123 and the coating 20 covering the suction side 121: thus, the presence of the coating 20 does not affect the flow of the stream of air through the inter-blade channel 102.

The mean thickness E of the coating lies in the range 10 μm to 500 μm.

In the example described, the critical zone 21 is the zone in which the flow section is measured so that the repair method of the invention enables the flow section of the blade 120 to be restored by building up the blade.

For the reasons set out above, said coating 20 presents a predetermined thickness that is precise and constant at the location of a critical zone 21 that corresponds in this example to the location where the flow section is measured (distance D2 in FIG. 1) and that is referred to as the throat of the suction side wall 121 (FIG. 2).

In this respect, and preferably, said coating 20 presents a thickness E1 in the critical zone 21 that lies in the range 10 μm to 500 μm, and in particular in the range 10 μm to 300 μm. Preferably, this thickness E1 is constant over the entire critical zone 21.

The term "critical" zone 21 should be understood as extending over the width L visible in FIGS. 2 and 3 and along the entire length of the blade 120, with its length direction being the direction that extends orthogonally to the sheets of all the figures.

Instead of having a mean thickness E that is relatively constant over its entire area, with the exception of its edges, the coating could present a thickness that begins to diminish on leaving the critical zone or throat 21, i.e. immediately after said critical zone 21.

By way of example, the blade 120 is a blade made of a superalloy based on nickel or cobalt, and in particular it may be of the standard AMl type (or NiTa8Cr8CoWA) of a low sulfur type: ReneN5, DSR142, Rene125 (or NiCo10Cr9WAlTaTiMo), IN100 (or NiCo15Cr10AlTi), CMSX4.

The coating 20 is constituted by a composite comprising a metallic matrix containing particles, of the $M_1CrAlM_2$ type where $M_1$ is selected from Ni, Co, or Fe, or a mixture thereof, and $M_2$ is selected from Y, Si, Ti, Hf, Ta, Nb, Mn, Pt, and rare earths.

The term "rare earths" is used to cover the elements belonging to the lanthanide group (lanthanum, cerium, praseodymium, neodymium, promethium, samarium, europium, gadolinium, terbium, dysprosium, holmium, erbium, thulium, ytterbium, and lutetium), scandium, yttrium, zirconium, and hafnium.

To deposit such a coating 20 of the $M_1CrAlM_2$ type, the electrolyte is formed from a solution in which the particles are particles of $CrAlM_2$, $M_2$ being selected from Y, Si, Ti, Hf, Ta, Nb, Mn, Pt, and rare earths.

An anode is also used that is made of a metal $M_1$, where $M_1$ is selected from Ni, Co, or Fe, or a mixture of these metals.

For example, in order to obtain a deposit of NiCrAlY, it is necessary to use a composite deposit comprising firstly nickel and secondly particles of CrAlY (Ni may be replaced by Co).

Coatings of NiCrAlY are produced by controlled co-deposition of CrAlY powder present in a conventional electrolyte bath together with nickel coming from the anode.

Under the effect of the potential difference applied between the electrodes (the cathode being formed by the part that is to be coated and the anode), the metal anode (in this example Ni) is oxidized and releases $Ni^{2+}$ ions into the solution. These ions move in the solution still under the effect of the potential difference and they go towards the cathode, being mixed on the way with the dispersed particles present in the solution. The assembly constituted by the ions and the particles then migrates towards the cathode and ends up by reaching its surface where it is deposited ($Ni^{2+}$ then being reduced to metallic Ni) thus forming a coating of NiCrAlY on the cathode in which the particles of CrAlY are finely dispersed within an Ni matrix.

It is then necessary to cause the assembly formed by the raw coating electroplated on the substrate to diffuse by applying appropriate heat treatment so as to make its composition uniform and obtain a two-phase coating:

$$M+CrAlY \rightarrow MCrAlY$$

Typically, the nozzle sector is subjected to heat treatment by being placed in a vacuum enclosure for about a time and temperature treatment suitable for the substrate material—a typical example of this may be 2 hours at 1080° C.

Figure 7:
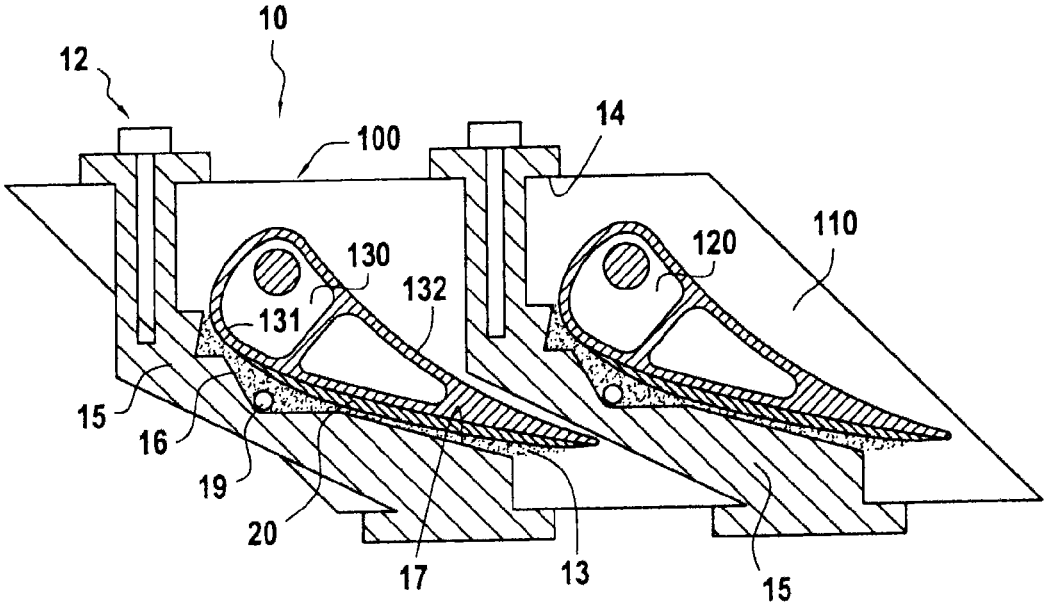
FIG. 7 is a diagram showing a possible example of an assembly of the invention comprising the tooling-forming support and blades mounted on said support in order to implement the method of the invention.

Reference is made to FIG. 7 which is a diagram showing an example of a co-deposition installation 10 enabling the method of the invention to be implemented.

For this purpose, the installation 10 comprises a support 12 made of a material that does not conduct electricity, presenting a reference wall 14 and suitable for receiving said blade 120, 130 in a working position relative to the reference wall 14.

In the example of FIG. 7, said support 12 is suitable for receiving two blades 120 and 130 in a working position relative to the reference wall 14. This constitutes mounting a complete nozzle sector 100 made up of two platforms (only the platform 110 is visible in FIG. 7) between which the two blades 120 and 130 extend.

Without going beyond the ambit of the present invention, it is possible to provide for the support 12 to be suitable for receiving more than two blades in a working position relative to the reference wall 14.

In this working position, the reference wall 14 of the support 12 is pressed against one of the two lateral faces 113, 114 of the platform 110 of the nozzle sector.

For each blade that is to be coated, the support 12 is fitted with means for controlling lines of current that enable them to be oriented by guiding them and concentrating them towards the wall of said blade that is to be coated.

For this purpose, in the embodiment shown in FIG. 7, for each blade 120, 130 of the sector 100, the support 12 comprises a longitudinal portion 15 fitted with a working wall 17 extending facing all of the suction side wall 131 of the corresponding blade 130, between its two longitudinal ends that are attached to the platform, and going from its leading edge to its trailing edge.

Thus, the support 12 in FIG. 7 comprises two identical longitudinal portions 15 that are mutually parallel serving firstly to limit and to orient the lines of current in the zone 13 extending between the working wall 17 and the surface to be coated (suction side wall 131). Secondly, the longitudinal portion 15 that lies between the two blades 120, 130 of the sector 100 form a screen for the pressure side wall 132 of the other blade 130, located on the opposite side of the working wall 17 of said longitudinal portion 15.

In order to create these lines of current in the zone 13, the working wall 17 is fitted, at location 16, with an anode 19 connected to a current source.

By way of example, this anode 19 is formed by a cylinder having a diameter of a few millimeters and made of a metal $M_1$, $M_1$ being selected from Ni, Co, and Fe, or a mixture thereof, in order to provide this or these elements to the solution and form the coating 20 of the $M_1CrAlM_2$ type. The shape of the anode may be selected from a number of different designs including but not limited to rod, bar, sheet or a shape following the form of the aerofoil.

This anode 19 is fastened to the longitudinal portion 15 that carries it. The profile and the position of the longitudinal portion 15 of the support 12 and of the anode 19 relative to the surface to be coated being selected so as to limit and orient the lines of current. The anode 19 is connected to a current source so as to generate a potential difference between the cathode (blade 130) and the anode 19.

Thus, the assembly visible in FIG. 7, comprising the support 12 and the nozzle sector 100 fastened in the working position thereof, is immersed in a bath of electrolyte prior to being subjected to the potential difference.

In particular because of the profile of the working wall 17 of the portion 15, which presents a shape that is generally complementary to the shape of the profile of the suction side wall 121, 131, and because of the distance between said wall 17 and the suction side wall 121, 131, it is possible to orient the field lines optimally for forming the coating 20 on the suction side wall 121, 131.

It is even possible to limit deposition of the coating 20 to the suction side wall 121, 131 only.

These geometrical parameters, and also the shape, the size, and the position of the anode 19, the potential difference, and the duration of the electrolytic co-deposition are optimized beforehand during modeling calculations so as to enable a coating 20 to be deposited with the desired characteristics.

This electrolytic co-deposition method has the effect of causing the cooling orifices and holes in the part to become obstructed little by little.

In certain circumstances, prior masking is performed on zones of the blade 120, 130 that are not to be coated, in particular at the locations of drilled and other holes.

For this purpose, sheets, e.g. of plastics material, are placed so as to cover the zones of the nozzle sector (or more generally of any part for coating) that are not to be covered during electrolytic co-deposition (for example the inner and outer platforms of the nozzle sector). It is also possible to use wax that is placed on the zones that are not to be covered, and in particular at the entrances of drilled and other holes so as to avoid the coating changing their size or obstructing them when it reaches them.

In an advantageous arrangement for obtaining a uniform coating, provision is made for controlled stirring of the powder in the electrolyte bath. For this purpose, in one implementation, while co-deposition is taking place, circulation is established in the solution with an upward flow in a first space of the solution and a downward flow in a second space of the solution, the support 12 being located in said second space.

In another arrangement that is advantageous for obtaining a coating of good quality, while co-deposition is taking place, the support 12 is caused to rotate about an axis having a horizontal component.

Reference may be made to EP 0 355 051 and EP 0 724 658 for the movement conditions applicable to the electrolyte and to the part in the electrolyte, and also for galvanic parameters.

Thus, by making a deposit by electrolytic co-deposition, it is possible to make a coating having any MCrAlY composition, or more generally $M_1CrAlM_2$ composition, while also achieving thicknesses that are controlled, in particular in the critical zone and along the edges.

Such coatings 20 obtained by electroplating also present the advantage of presenting very small roughness (Ra of the order of 1 μm to 2 μm), of not being porous, and of achieving a strong (metallic) bond between the substrate and the coating.

It should also be observed that implementing this method of electrolytic co-deposition enables parts to be coated that are complex in shape, since the method is not totally directional and the entire surface of the part is in contact with the bath of electrolyte.

Furthermore, such a method has the advantage of not subjecting the substrate to thermal stress.

The invention claimed is:

1. A method of electrolytically depositing a composite coating comprising a metallic matrix containing particles, to repair a metal blade, the method comprising:

providing at least one blade forming a cathode and presenting a surface to be coated that defines a critical zone and extends in a longitudinal direction between a root and tip of the blade;

providing an anode made of a metal and connecting an anode to a current source;

providing a solution forming an electrolyte bath and containing insoluble particles;

providing a support made of a material that does n conduct electricity, that presents a reference wall, and that is configured to receive the blade in a working position relative to the reference wall;

mounting the blade on the support in the working position;

placing the support in the solution; and co-depositing particles and metal from the anode to forma coating on the surface to be coated, wherein the anode is placed facing the critical zone, wherein the support is fitted, for each blade, with a longitudinal portion facing the surface to be coated of the blade, the longitudinal portion being fitted with a working wall so as to obtain, on the surface to be coated of the blade, a coating presenting varying thickness that is predetermined and relatively constant for the critical zone and that decreases progressively down to a value of zero along edges of the coating, wherein the surface to be coated of the blade is a suction side wall of the blade, and the critical zone is closer to a leading edge of the blade than a trailing edge of the blade, wherein working wall extends so as to face all of the suction side wall of the blade between the leading edge of the blade and the trailing edge of the blade, a shape of the working wall being complementary to a shape of the suction side of the blade, and wherein the anode is fastened to the longitudinal portion at a location facing the critical zone of the suction side wall of the blade.

2. A method according to claim 1, wherein the anode extends in the longitudinal direction and a profile and position of the longitudinal portion of the support and of the anode relative to the surface to be coated are selected to limit and orient the lines of current.

3. A method according to claim 1, wherein the composite coating comprising a metallic matrix containing particles is of $M_1CrAlM_2$ type, wherein the anode is made of a metal $M_1$, $M_1$ selected from Ni, Co, and Fe, or a mixture thereof, and wherein the particles of the solution are particles of $CrAlM_2$, where $M_2$ is selected from Y, Si, Ti, Ta, Nb, Mn, Pt, and rare earths.

4. A method according to claim 1, wherein the coating presents a thickness in the critical zone in a range 10 μM to 500 μm.

5. A method according to claim 1, wherein the critical zone is a zone in which a flow section is measured such that the repair method enables the flow section of the blade to be restored by being built up.

6. A method according to claim 1, wherein the support is configured to receive two blades in a working position relative to the reference wall.

7. A method according to claim 1, wherein the support is configured to receive more than two blades in a working position relative to the reference wall.

8. A method according to claim 1, wherein the blade is a blade of a turbomachine nozzle.

9. A method according to claim 1, wherein zones of the blade that are not to be coated are masked beforehand, at locations of drilled and other holes.

10. A method according to claim 1, wherein, while deposition is taking place, circulation is established in the solution with an upward flow in a first space of the solution and a downward flow in a second space of the solution, the support being placed in the second space.

11. A method according to claim 1, wherein while co-deposition is taking place, the support is caused to rotate about an axis that includes a horizontal component.

12. A method of restoring blades comprising:

(i) removing existing coatings from a blade to form a surface to be coated;

(ii) preparing or cleansing the surface to be coated;

(iii) coating the surface to be coated of the blade with $M_1CrAlM_2$ type material, according to the method of claim 1, to build up the blade; and (iv) implementing a diffusion heat treatment.

13. An assembly for electrolytically depositing a coating on a blade, the assembly comprising:

at least one blade forming a cathode and presenting a surface to be coated that defines a critical zone and extends in a longitudinal direction between a root and a tip of the blade; and a support made of a material that does not conduct electricity, presenting a reference wall, and configured to receive the blade in a working position relative to the reference wall, the support further comprising, for each blade, a longitudinal portion configured to face the surface to be coated of the blade, the longitudinal portion defining a location for an anode extending in a longitudinal direction and facing the critical zone, profiles and positions of the longitudinal portion of the support and of the anode relative to the surface to be coated being selected to limit and orient lines of current to obtain, on the surface to be coated of the blade, a coating presenting varying thickness that is predetermined and relatively constant for the critical zone and that decreases progressively to a value of zero along edges of the coating, wherein the surface to be coated of the blade is a suction side wall of the blade, and the critical zone is closer to a leading edge of the blade than a trailing edge of the blade, wherein the working wall extends so as to face all of the suction side wall of the blade between the leading edge of the blade and the trailing edge of the blade, a shape of the working wall being complementary to a shape of the suction side of the blade, and wherein the anode is fastened to the longitudinal portion at a location facing the critical zone of the suction side wall of the blade.

14. A method according to claim 1, wherein the mounting the blade includes pressing a lateral face of a platform of a nozzle sector against the reference wall.

15. A me according to claim 1, wherein the longitudinal portion presents a screen between the suction side of the blade to be coated and a pressure side of an adjacent blade.

* * * * *